United States Patent [19]

Ooms et al.

[11] Patent Number: 4,756,990

[45] Date of Patent: Jul. 12, 1988

[54] METHOD OF EFFECTING HIGH CONTRAST DEVELOPMENT OF AN IMAGE-WISE EXPOSED PHOTOGRAPHIC SILVER HALIDE EMULSION LAYER MATERIAL

[75] Inventors: Richard A. Ooms, Mechelen; Robert J. Pollet, Vremde, both of Belgium

[73] Assignee: AGFA-Gevaert N.V., Mortsel, Belgium

[21] Appl. No.: 843,281

[22] Filed: Mar. 24, 1986

[30] Foreign Application Priority Data

Mar. 26, 1985 [EP] European Pat. Off. ..... 85200464.7

[51] Int. Cl.[4] ..... G03C 5/24; G03C 5/30

[52] U.S. Cl. ..... 430/438; 430/268; 430/449; 430/466; 430/487; 430/489

[58] Field of Search ..... 430/268, 489, 449, 487, 430/466, 438

[56] References Cited

U.S. PATENT DOCUMENTS 3,972,719 8/1976 Vanreusel et al. ..... 430/446 X
4,172,728 10/1979 Sincius et al. ..... 430/268

FOREIGN PATENT DOCUMENTS 945340 12/1963 United Kingdom .
2010514 6/1979 United Kingdom .

OTHER PUBLICATIONS

Research Disclosure, Dec. 1931, #21210, p. 428.
Research Disclosure, Jun. 1984, #24236, p. 274.

*Primary Examiner*—Mukund J. Shah
*Attorney, Agent, or Firm*—William J. Daniel

[57] ABSTRACT

A method of effecting high contrast development of an image-wise exposed photographic silver halide emulsion layer material wherein the developing proceeds in an aqueous medium having a pH of 10 to 12 and containing:

(a)
- (i) hydroquinone or a substituted hydroquinone,
- (ii) an auxiliary developing agent having a developing activity of such degree as to give when utilized in the Standard Development Test defined in the specification a relative development rate ($f_x$) in the range of about 1–2

(b) free sulphite ions in an amount of at least 5 grams per liter of the medium, (c) an organic anti-fogging agent, and (d) a polymer containing a plurality of alkylene oxide units having a molecular weight of at least about 1500.

13 Claims, No Drawings

METHOD OF EFFECTING HIGH CONTRAST DEVELOPMENT OF AN IMAGE-WISE EXPOSED PHOTOGRAPHIC SILVER HALIDE EMULSION LAYER MATERIAL

This invention relates to a method of effecting high contrast development of an image-wise exposed photographic silver halide emulsion layer material.

In the reproduction of continuous tone information for mechanical printing purposes, it is customary to make a half-tone photographic intermediate, usually a film negative, in which the gradations in tone of the image are represented by dots of differing size. The quality of the resulting halftone picture is closely connected with the shape, spectral density, and uniformity of the dots of the half-tone print.

In order to obtain very high-contrast screen dots in halftone images it has been practice to formulate developers, so-called lith-developers, containing essentially a p-dihydroxybenzene such as hydroquinone, an alkali an alkali metal bromide and a low level of free sulphite ions.

Very high contrast results, preferably with gamma above 10, also called "lith-gradation", can be obtained with these high-contrast developers and so-called "lith silver halide emulsion materials". In these materials the silver halide comprises at least 50 mole % of chloride, the balance, if any, being bromide and optionally a minor amount of iodide. The relationship of lith-gradation and sharpness of screen dots is discussed in the handbook of Modern Halftone Photography of E. Fred Noemer—published by Perfect Graphic Arts Demarest, N.J.—U.S.A. (1965) pages 54–55.

Hydroquinone developers having a low sulphite ion concentration are commonly referred to as "lith-type developers" and their mechanism of operation is described by J. A. C. Yule in the Journal of the Franklin Institute, 239 (1945), pages 221 to 230.

The properties of these lith-type developers are believed to result from autocatalytic action, often called "infectious development", due to a local high concentration of the oxidation products of the developing agent, which can build up as a result of the low sulphite ion concentration that has to be kept at low level to maintain the lith-development characteristic. This is achieved in all known commercial developers of this type by the use of the addition product of formaldehyde and sodium hydrogen sulphite, i.e. sodium formaldehyde hydrogen sulphite, which acts as a sulphite ion buffer.

Convential "lith" developers suffer from deficiencies which restrict their usefulness. For example, the developer exhibits low development capacity as a result of the fact that it contains hydroquinone as the sole developing agent. Also, the aldehyde tends to react with the hydroquinone to cause undesirable changes in development activity. Furthermore, the low sulfite ion concentration is inadequate to provide effective protection against aerial oxidation. As a result, a conventional "lith" developer is lacking in stability and tends to give erratic results depending on the length of time that it has been exposed to air.

With the advent of processing machines and more particularly, rapid access processing machines, the deficiencies of lithographic processing chemistry became serious and apparent. Developer degradation was accelerated under machine processing conditions. The lag in the start of development caused by the long induction period of the hydroquinone developers lengthened the processing time and delayed access to the finished product. In machine-processing the classical lith-developer based on the exclusive use of hydroquinone having relatively low developing activity on its own poses a further problem in the so-called "cross-over" of the photographic material between the development tank and the fix tank. Indeed, if one considers development time to start when the film first enters the developer and to end when it first enters the fix tank then a rather large time is spent in the cross-over. In this cross-over, the exhausted developer has no chance to be replenished by fresh developer because the film is out of solution. Thus, during the cross-over period, development is prematurely terminated owing to local developer exhaustion. This leads to a low contrast or so-called "pulled-out" toe which gives significantly poorer dot quality. Said problem is particularly apparent when classical lith-development is carried out in shallow processing tanks or trays operating with a relatively large cross-over time, so that to avoid that problem machine-processing in classical lith-development has to proceed within a relatively long path of travel in relatively deep tanks to increase the development time with respect to the cross-over time. This makes the developer apparatus expensive and bulky by the use of an extensive roller transport system.

As is generally known the composition of a developer solution used in silver halide photography changes because of the chemical reaction taking place in the development and by contact with the oxygen of the air. These chemical changes have a certain influence on the photographic characteristics of the finally obtained images.

In the development of the exposed silver halide emulsion a certain quantity of the developing compounds and of the oxidation-inhibiting compounds is used up and halide ions of the developed silver halide enter the developing solution.

How fast the exhaustion of the developer proceeds is dependent on the number and kind of photographic material processed and the content of developable (exposed or fogged) silver halide in the material.

The continuous contact of the developer solution with the oxygen of the air also results in the oxidation of an amount of the developing agents and oxidation-inhibiting compounds and in this way changes the reducing capacity of the developer. The longer the contact time and the larger the area of contact between the developer liquid and the air the more rapidly oxidation will take place. Aerial oxidation is also influenced by the temperature of the developer solution i.e. the higher the temperature, the more intense the aerial oxidation proceeds.

As explained e.g. in U.S. Pat. No. 4,081,280 it is necessary when using lith-developer with low free sulphite content to replenish carefully the developer solution in order to compensate:

(1) for developer exhaustion by aerial oxidation, and (2) for use of developer as a function of the treated exposed photographic material.

According to GB-P No. 1,376,600 and corresponding U.S. Pat. No. 3,972,719 in order to reduce the need for replenishment for aerial oxidation a high contrast developer with relatively high sulphite content and an anti-fogging nitro-compound is provided. This developer contains not more than 0.05 g/liter of any auxiliary developing agent that shows a superadditive developing effect with a p-dihydroxybenzene developing agent and may contain a polymer containing a plurality of alkylene oxide units, i.e. a polymeric oxyalkylene compound, for controlling the development speed.

It has been established experimentally that a particularly high dot sharpness under the conditions of high free sulphite content is due to a synergistic effect of nitro-indazole and the polymer containing a plurality of alkylene oxide units.

Although the keeping properties of such kind of high contrast developer have been improved very much, the activity of the developer remains low so that it is stilI not suited for rapid access processing or processing in inexpensive shallow tank processors operating with relatively large cross-over times.

By using so-called "rapid-access" developers containing both hydroquinone and an auxiliary developing agent, such as 1-phenyl-3-pyrazolidinone and N-methyl-p-aminophenol sulphate, the induction period can be eliminated and the developing process speeded up. The developing liquids containing an auxiliary developing agent are more stable with respect to oxidation by oxygen of the air than developers containing hydroquinone as the sole developing agent. However, the trouble is that these auxiliary developing agents are not suited for use in lithographic development because they cannot produce the necessary high gradient. Still it remains desirable to combine high contrast development with the processing convenience and stability of the rapid access developers.

For that purpose in GB-P No. 2,010,514 a process is described for preparing a high contrast silver image having a gradient of at least 5.0 calculated from the difference in relative Log E values measured at densities of 0.3 and 3.5 on a Log E scale, comprising the steps of exposing a photosensitive silver halide emulsion and developing of the resultant image in a developer consisting essentially of:

(a)

(i) hydroquinone or a substituted hydroquinone in an amount of 4 to 35 grams per liter, (ii) an auxiliary superadditive developing agent in an amount of 0.04 to 3.5 grams per liter, (b) an alkali metal sulphite in an amount of 15 to 60 grams per liter, (c) an organic anti-fogging agent selected from 5-nitroindazole, 6-nitroindazole and 5-nitrobenzimidazole in an amount of 0.09 to 5 grams per liter, (d) an alkanolamine in an amount of 20 to 175 grams per liter, said developer having a pH of 10 to 12.

It has been established experimentally by us that the presence of a common 1-phenyl-3-pyrazolidinone or N-methyl-p-aminophenol auxiliary developing agent requires the use of particularly large amounts of anti-fogging agent to obtain high contrast development results. These high amounts of anti-fogging agent impair the dot structure by giving it an indented (non-sharp) appearance especially when the development is carried out in the absence of said alkanolamine.

It is an object of the present invention to provide a development process for the development of an image-wise exposed photographic silver halide emulsion material, wherein said process is a rapid access processing using a developer being capable of high contrast development, e.g. of screen dots in a halftone image, and having improved stability.

It is a further object of the present invention to provide a process of high contrast development of an image-wise exposed photographic silver halide emulsion material proceeding with relatively large cross-over times, e.g. in shallow tanks, without degrading screen dot quality desired in the production of halftone images.

The present invention provides a method of effecting high contrast development of an image-wise exposed photographic silver halide emulsion layer material, characterized in that the development is effected in an aqueous medium which has a pH of 10 to 12 and which contains:

(a)

(i) hydroquinone or a substituted hydroquinone, (ii) an auxiliary developing agent having a developing activity such that in the event that the Standard Development Test hereafter defined is performed using that auxiliary developing agent as the auxiliary developing agent constituent of the comparative developer employed in that test, the relative development rate $f_x$ determined according to that test would be below 2.5, preferably from 2 to 1, (b) free sulphite ions in an amount of at least 5 grams per liter, (c) an organic anti-fogging agent corresponding to one of the following general formulae (A) and (B):

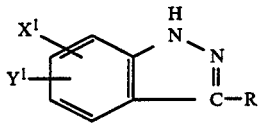

(A)

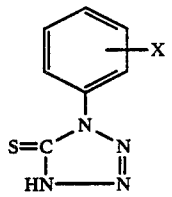

(B)

$Y^1$ is a nitro-substituent in the 5- or 6-position of the indazole nucleus, $X^1$ is hydrogen or a sulphonic acid group in salt form, R is hydrogen or a lower ($C_1$–$C_5$) alkyl group.

X is a substituent being or containing a carboxyl group or sulphonic acid group in salt form; and (d) a polymer containing a plurality of alkylene oxide units and having a molecular weight of at least 1500, said ingredients (a) to (d) being present in the development of said image-wise exposed photographic material in such relative amounts that if a latent continuous tone wedge image were developed under the same development conditions in that photographic material the density versus log exposure sensitometric curve of the resulting silver wedge image would have a maximum gradient ($\gamma$) of at least 5.0 between the log exposure values measured at densities of 0.3 and 3.0 above fog on the log exposure scale and would have a gradient ($\gamma_v$) of at least 2.0 in the toe between the log exposure values meassured at densities of 0.1 and 0.6 above fog on the log exposure scale; the Standard Development Test specified above being as follows:

Standard Development Test

Photographic material employed

The photographic material contains a polyester film support coated with a gelatin-silver halide emulsion comprising silver bromide-iodide (2 mole % of iodide) at a coverage equivalent with 4 g of silver per sq.m and a gelatin coverage of 9.6 g per sq.m. The average grain size of the silver halide is 0.2 $\mu$ m. The silver halide emulsion is of the ammoniacal type prepared by double jet precipitation, has been chemically sensitized with 0.03 g of 3-allyl-5,5 dimethylthiohydantoine per mole of silver halide at a temperature of 52° C. for a period of 5 h at a pAg of 9 and a pH of 7 and has been stabilized before coating by adding thereto 200 mg of 7-hydroxy-5-methyl-triazolo [1,5-a]-pyrimidine and 15 mg of 1-phenyl-2-tetrazoline-5-thione per mole of silver halide.

Exposure

Two pieces of such photographic material are contact exposed through a continuous tone grey wedge with constant 0.15.

| Reference Developer: | |
|---|---|
| sodium carbonate | 20 g |
| sodium hexametaphosphate | 1 g |
| sodium sulphite | 20 g |
| potassium bromide | 0.5 g |
| hydroquinone | 4.4 g |
| water up to | 1 liter |
| pH | 10.4 |

Test Procedure

One of the two pieces of contact exposed photographic material is developed by means of the Reference Developer at 20° C. and the time $t_h$ required to obtain a density of 0.5 above fog is measured. The other of said pieces is developed at 20° C. by means of a comparative developer which is identical to the Reference Developer except that is contains 0.31 millimoles of the auxiliary developing agent to be tested and the time $t_x$ required to obtain a maximum density of 0.5 above fog is measured. The two development times are compared to obtain the relative development rate $f_x$, which is the ratio $t_h/t_x$.

Auxiliary developing agents that comply with the above Standard Development Test are listed in the following Table 1 with the corresponding $f_x$-values determined by the Standard Development Test herein defined. The compounds 10, 11 and 12 are given for comparative purposes.

TABLE 1

| Developing agent | $f_x$ |
|---|---|
| 1. p-phenylene diamine sulphate | 1.06 |
| 2. 1-p-carboxyphenyl-4,4-dimethyl-3-pyrazolidinone | 1.25 |
| 3. N,N—diethyl-p-phenylene diamine hydrochloride | 1.38 |
| 4. p-amino-phenol | 1.49 |
| 5. N,N—diethyl-N'—ethyl-N'—4-sulphobutyl-p-phenylene diamine hydrochloride | 1.96 |
| 6. N—2-hydroxyethyl-N—methyl-p-aminophenol hydrochloride | 1.98 |
| 7. 1-m-chlorophenyl-4,4-dimethyl-3-pyrazolidinone | 2.00 |
| 8. N,N—diethyl-N'—hydroxyethyl-p-phenylene diamine dihydrochloride | 2.08 |
| 9. N,N—diethyl-N',N'—dihydroxyethyl-p-phenylene diamine dihydrochloride | 2.44 |
| 10. N—methyl-p-aminophenol sulphate | 2.50 |
| 11. 1-phenyl-4,4-dimethyl-3-pyrazolidinone | 4.76 |

TABLE 1-continued

| Developing agent | $f_x$ |
|---|---|
| 12. 1-phenyl-3-pyrazolidinone | 5.41 |

It will be apparent that many of the developing agents listed in Table 1 are commercial products. Some belong to the class of p-aminophenol type developers and p-phenylenediamine type developers, others are 1-phenyl-3-pyrazolidinone type developing agents having an electron-withdrawing group on the phenyl nucleus, e.g. ester group, or an anionic group, e.g. acid group that in alkaline medium is transformed into salt group. By said groups the electron-availability over said nucleus is decreased and reducing power is lowered.

For illustrative purposes the preparation of non-commercial developing agents listed in the above Table 1 is given hereinafter:

PREPARATION OF DEVELOPING AGENT 2

To a suspension of 228 g (1.5 mole) of p-carboxyphenylhydrazine in a mixture of 237 g of pyridine and 2.5 l of dioxan were added 232.5 g (1.5 mole) of $\beta$-chloropivaloyl chloride. The temperature rose to 50° C. The reaction mixture was then kept boiling with reflux for 6 h. After cooling the formed precipitate was separated by filtering and washed with water. Thereupon the precipitate was stirred in a mixture of 1 l of water and 100 ml of 5N hydrochloric acid. The solid residue was separated by suction filtering, washed with 3 l of water and dried. Yield: 244 g. Melting point above 200° C.

PREPARATION OF DEVELOPING AGENT 5

1 mole of N,N,N'-triethyl-p-phenylene diamine were sulphoalkylated at 110° C. with 1 mole of 1,4-butane sultone. The reaction mixture was dissolved in hot water, extracted with ether and the aqueous solution was acidified with concentrated hydrochloric acid. After concentrating under vacuum the residue was purified with ethanol. Melting point: 204°–210° C.

PREPARATION OF DEVELOPING AGENT 6

1 mole of p-methylamino phenol was alkylated under nitrogen-atmosphere with 1.1 mole of 2-chloroethanol in a mixture of water and 2-methoxy-ethanol by dropwise adding at boiling temperature an aqueous solution of 1.1 mole of sodium hydroxide. After cooling the reaction mixture was acidified with concentrated hydrochloric acid and concentrated under vacuum, whereupon the product was purified by crystallisation from a mixture of ethanol and toluene and recrystallised from ethanol. Melting point: 156° C.

PREPARATION OF DEVELOPING AGENT 8

1 mole of N,N-diethyl-p-phenylene diamine was mono-alkylated under nitrogen-atmosphere with 0.5 mole of 2-chloro-ethanol in a mixture of boiling water/2-methoxy-ethanol. The reaction mixture was made alkaline and extracted with methylene chloride. After a treatment with absorbing carbon and drying the reaction mixture was concentrated by evaporation under vacuum hereby obtaining an oily residue. The purification proceeded by distillation collecting the fraction boiling at 160°–166° C. at a pressure of 0.5 mm Hg. The free base was dissolved in methylene chloride and transformed into the hydrochloride with concentrated hydrochloric acid. The aqueous layer was evaporated and the residue was crystallised from n-propanol. Melting point: 135° C.

PREPARATION OF DEVELOPING AGENT 9

Research Disclosure, dec. 1981, item 21210 (Agfa-Gevaert N.V.).

Hydroquinone compounds that may be used according to the present invention include unsubstituted hydroquinone and substituted hydroquinones e.g.:

chlorohydroquinone,
bromohydroquinone,
isopropylhydroquinone,
toluhydroquinone,
methylhydroquinone,
2,3-dichlorohydroquinone,
2,5-dimethylhydroquinone,
2,3-dibromohydroquinone,
1,4-dihydroxy-2-acetophenone-2,5-dimethylhydroquinone,
2,5-diethylhydroquinone,
2,5-di-p-phenethylhydroquinone,
2,5-dibenzoylaminohydroquinone, or
2,5-diacetaminohydroquinone and mixtures thereof.

The preparation of these hydroquinone compounds is known to those skilled in the art.

The hydroquinone and the auxiliary developing agents according to (ii) are used preferably in a molar ratio in the range of 100/1 to 1000/1.

The developing agent(s) may be present in the photographic material, e.g. in a silver halide photographic emulsion layer or in a layer in water-permeable relationship therewith. In that case the development may be carried out by contacting the photographic material with an alkaline aqueous liquid free from developing agent(s) but containing optionally the other ingredients (c) and/or (d).

The above defined nitro-indazole anti-fogging agents (A) can be prepared as described in GB-P No. 1,376,600.

The defined tetrazole anti-fogging agents (B) can be prepared as described in Research Disclosure, June 1984, item 24236.

The concentration of the anti-fogging agent is normally in the range of 0.05 to 1 g per liter of developer.

According to a particularly preferred embodiment in the process of the present invention an aqueous alkaline developer composition is used that has a pH between 10 and 12 and contains 5-nitro-indazole in an amount of 50 to 300 mg per liter.

The above anti-fogging agents may be present in the light-sensitive material but they are preferably incorporated into the high contrast developer itself.

The sulphite ions are incorporated into the developer composition starting preferably from an alkaline metal hydrogen bisulphite or metabisulphite or a corresponding ammonium salt. The concentration of free sulphite ion is preferably in the range of 15 to 80 grams per liter.

Suitable polyalkylene oxide polymers also called polymeric oxyalkylene compounds for use according to the present invention are described e.g. in the United Kingdom Patent Specification Nos. 600,058 filed Jan. 10, 1946 by E.I. du Pont de Nemours, 871,801 filed Nov. 30, 1956 by Kodak, 920,637 filed May 7, 1959, 940,051 filed Nov. 1, 1961, 945,340 filed Oct. 23, 1961, 949,643 filed Nov. 2, 1961 all four by Gevaert Photo-Producten N.V., 991,608 filed June 14, 1961 by Kodak, 1,015,023 filed Dec. 24, 1962, 1,091,705 filed May 20, 1965, both by Gevaert Photo-Producten N.V., 1,107,022 filed Oct. 7, 1965, 1,147,817 filed Aug. 19, 1966, 1,162,135 filed Oct. 11, 1965 and 1,184,434 filed Aug. 30, 1966 all four by Gevaert-Agfa N.V., in the publlshed German Patent Application Nos. 1,141,531 filed Jan. 24, 1962 by Perutz Photowerke G.m.b.H., 1,188,439 filed May 16, 1964 by Fuji Shashin Film Kabushiki Kaisha, and in the United States patent specifications Nos. 1,970,578 of Conrad Schoeller and Max Wittwer, issued Aug. 21, 1934, 2,240,472 of Donald R. Swan, issued Apr. 29, 1941, 2,423,549 of Ralph K. Blake, William Alexander Stanton, Ferdinand Schulze, issued July 8, 1947, 2,441,389 of Ralph K. Blake, issued May 11, 1948.

A preferred polyoxyalkylene compound for use in the present development process is a polyoxyethylene glycol with an average molecular weight of at least 1500 and especially a polyoxyethylene condensation product prepared as described in preparation 2 of British Patent Specification 945,340.

The polyoxyalkylene compounds may be present in the developer in the range of 0.01 g to 10 g per liter of developer composition.

The polyoxyalkylene compounds may be present in the photographic material, e.g. in the silver halide emulsion layer and/or in a layer in waterpermeable relationship therewith.

Other adjuvants well known to those skilled in the art of developer formulation may be added to the present developer to perform the various functions for which they are intended.

A survey of conventional developer addenda is given by Grant Haist in "Modern Photographic Processing-"—John Wiley and Sons—New York (1979) pp. 220–274. Such addenda are e.g. restrainers, such as the soluble halides, e.g. applied as potassium bromide, organic solvents improving the solubility of developing agents, preservatives, e.g. biocides and puffering agents, e.g. carbonates, phosphates and borates.

The developer composition used according to the present invention may contain free bromide ions the concentration of which is preferably in the range of 0.2 to 5.0 g per liter developer solution.

The developer used according to the present invention may contain organic solvent(s) for the developing agents and/or antifogging agents.

Organic solvent(s) for the hydroquinone and/or 3-pyrazolidinone developers are described e.g. in U.S. Pat. No. 4,030,920, GB-P No. 1,343,718 and FR-P No. 71.41095 (publication No. 2,114,785). Suitable solvents for use according to the present invention are watermiscible solvents of the class of amides, alcohols, organic diol compounds and half-ethers thereof. Preferred watermiscible solvents are dimethylformamide, dimethylacetamide, N-methyl-2-pyrrolidinone and 3-methoxy-2-propanol. These solvents may be present in an amount in the range of 5 to 250 g per liter.

The developer formulation may be prepared in a concentrated form and diluted to a working strength just prior to use. Concentrated solutions for automatic processing are widely used in processing machines operating with a replenishment system. The developer may be kept in two parts before use and combined and diluted to the desired strength with water. Thus, the auxiliary developing agent(s) and antifogging agent(s) may be kept in acid medium in one part and the other ingredients in alkaline medium in the other part.

Developer solutions used according to the present invention can be left in a machine processor for several weeks without marked degradation and replenishment proceeds simply by adding a fresh amount of developer after discarding an exhausted portion.

Useful photographic silver halide emulsion elements for processing according to the present invention are silver chloride emulsion elements as conventionally employed in forming "lith" photographic elements as well as silver bromide and silverbromoiodide emulsion elements which are capable of attaining higher photographic speeds. Preferably the silver chloride emulsion elements comprise at least 50 mole % of chloride, more preferably at least 70 mole % of chloride, the balance, if any, being bromide. The silver halide may also contain a small amount of iodide, e.g. less than 5 mole %, if desired.

A silver halide emulsion layer suitable for processing according to the present invention may contain any of hydrophilic water-permeable binding materials suitable for this purpose. Suitable materials include gelatin, colloidal albumin, polyvinyl compounds, cellulose derivatives, acrylamide polymers etc. Mixtures of these binding agents may be used. The binding agents for the emulsion layer of the high contrast photographic element may also contain dispersed polymerized vinyl compounds. Such compounds are disclosed in e.g. the U.S. patent specification Nos. 3,142,568 of Robert William Nottorf, issued July 28, 1964, 3,193,386 of Clayton F. A. White, issued July 6, 1965, 3,062,674 of Robert Wong, issued Nov. 6, 1962, 3,220,844 of Robert C. Houck, Donald A. Smith and Joseph S. Yudelson, issued Nov. 30, 1965. They include the water-insoluble polymers of alkyl acrylates and methacrylates, acrylic acid, sulfoalkyl acrylates or methacrylates, copolymers of alkyl acrylates with acrylic acids, acryloyl-oxyalkyl sulphonic acids, acetoacetoxy alkyl acrylates such as 2-acetoacetoxyethyl methacrylate and the like. These compounds may be incorporated likewise into a layer separate from the silver halide emulsion layer of the photographic element. The vinyl polymers are generally employed in concentrations of about 20 to about 80%, most often concentrations of at least 50% by weight, based on the weight of the binding agent.

Silver halide emulsions wherein the binding agent contains a dispersed polymerized vinyl compound provide particularly good results in eliminating drag streaks and dot distortions.

The silver halide emulsion of the high-contrast photographic elements, which can be processed according to the present invention may be coated on a wide variety of supports. If desired, hydrophilic colloid layers are coated on one or both sides of the support.

Typical supports are cellulose nitrate film, cellulose ester film, polyvinyl acetal film, polystyrene film, poly(ethylene terephthalate) film, and related films or resinous materials, as well as glass, paper, metal and the like. Supports such as paper, which are coated with α-olefin polymers, particularly polymers of α-olefins containing two or more carbon atoms, as exemplified by polyethylene polypropylene, ethylene-butene copolymers and the like may be employed likewise.

A silver halide emulsion material suitable for processing according to the present invention may be sensitized chemically according to any of the well-known techniques in emulsion making, e.g. by digesting with naturally active gelatin or various sulphur. selenium, tellurium compounds and/or gold compounds. The emulsions can be sensitized with salts of noble metals of Group VIII of the Periodic Table, which have an atomic weight higher than 100.

A silver halide emulsion material suitable for processing according to the present invention may be sensitized spectrally, e.g. is ortho-sensitized or pan-sensitized, with known spectral sensitizing dyes. For instance, the silver halide can be sensitized spectrally by treatment with a solution of a sensitizing dye in an organic solvent. Spectral sensiti zers that may be used are e.g. the cyanines, merocyanines, complex (trinuclear) cyanines, complex (trinuclear) merocyanines, styryls, and hemicyanines.

A silver halide emulsion materiaI to be processed according to the present invention may also contain conventional addenda such as gelatin, plasticizers, coating aids, fog-inhibiting compounds other than the already mentioned compounds (A) and (B), such as benzoxazole, benzthiazole, benzimidazole, benztriazole and azaindene compounds, and hardeners, e.g. aldehyde hardeners such as formaldehyde, mucochloric acid, glutardialdehyde and maleic dialdehyde, aziridines, oxypolysaccharides, dimethylurea, hydroxychlorotriazine, divinyl sulphones and/or triacrylformal.

In processing photographic elements according to the present invention, the time and temperature employed for development can be varied widely. Typically, the development temperature will be in the range of from about 20° C. to about 50° C., while the development time in rapid access normally no longer lasts than 90 s.

The following examples illustrate the invention.

EXAMPLE 1

(Comparative Test Example)

A fine grain (average grain size 0.15 μm) silver chloride-bromide (90/10 mole %) emulsion being chemically sensitized with gold(III) chloride and sodium thiosulphate was after being spectrally sensitized to green light coated at a gelatin coverage of 3.2 g per sq.m and a coverage of silver halide equivalent to 2.5 g of silver per sq.m. The silver halide emulsion layer contained per mole of silver halide 0.1 g of polyethylene glycol having an average number of 70 repeating oxyethylene units. The silver halide emulsion layer was coated with a protective layer containing formaldehyde hardened gelatin at a coverage of 0.8 g of gelatin per sq.m.

The photographic material was contact-exposed in different area through respectively a continuous tone wedge having a constant 0.15 and a magenta screen for use in screen sensitometry having a screen ruling of 54 lines per cm.

The development proceeded by dipping the exposed photographic material nto a tray for 35 s at a temperature of 28 ° C. using a developer having the following composition:

| | |
|---|---|
| ethylenediamine tetra-acetic acid sodium salt | 1 g |
| sodium carbonate | 50 g |
| boric acid | 6 g |
| potassium bromide | 2 g |
| sodium sulphite | 30 g |
| hydroquinone | 27.5 g |
| 1-methoxy-2-propanol | 50 ml |
| water up to | 1 l |
| pH adjusted to 11 with sodium hydroxide. | |

For comparative test purposes to said developer 0.50 mmole of one of the auxiliary developing agents listed hereinafter in Table 2 were added.

In said Table 2 amounts of 5-nitro-indazole (NI) are listed which were added to obtain with the specified auxiliary developing agent a dot screen quality as high as possible. Further in said Table 2 relative sensitivity values (rel. S), gradient values in the toe ($\gamma_v$) of the sensitometric curve as defined hereinbefore and maximum gradient values ($\gamma$) are mentioned.

The sensitivity values, also called speed, were measured at density (D) 3.0 above fog. The sample corresponding with test 1 was given the relative sensitivity value 100, the values obtained throughout the other tests and examples described hereinafter are percent values relating to the value 100 of said test 1.

The dot quality is defined by ratings 1 to 5, wherein the lower numbers stand for the better dot quality. Number 1 stands for developed screen dots having high optical density and sharp, non-indented edges. The other numbers relate to screen dots having gradually reduced optical density and dot edges with increasing indentation and fuzzy structure. Above number 3 the quality is considered to be no longer commercially acceptable.

TABLE 2

| Test no. | Auxiliary developing agent no. | NI mmole/l | rel. S | γ v | γ | dot quality rating |
|---|---|---|---|---|---|---|
| 1 | — | 0.43 | 100 | 6.1 | 9.1 | 1 |
| 2 | 1 | 0.43 | 170 | 5.7 | 12.5 | 1 |
| 3 | 2 | 0.43 | 154 | 6.3 | 9.0 | 1 |
| 4 | 3 | 0.43 | 172 | 3.7 | 8.1 | 1–2 |
| 5 | 4 | 0.43 | 148 | 5.2 | 9.1 | 1 |
| 6 | 6 | 0.43 | 201 | 1.8 | 4.5 | 4 |
| 7 | 6 | 0.86 | 155 | 3.8 | 6.8 | 1–2 |
| 8 | 10 | 0.43 | 179 | 1.7 | 4.0 | 4–5 |
| 9 | 10 | 1.84 | 136 | 1.9 | 4.8 | 3–4 |
| 10 | 11 | 0.43 | 171 | 1.4 | 3.7 | 5 |
| 11 | 11 | 12.3 | 126 | 1.4 | 3.8 | 5 |

From the results in Table 2 can be learned that the more active auxiliary developing agents (see the $f_x$ value in Table 1) need more 5-nitro-indazxole to obtain the high gradation values for lith-development and that such is not in favour of screen dot quality.

A good screen dot quality is obtained where $\gamma_v$ is at least 2 and $\gamma$ is at least 5. Such is made possible by the use of auxiliary developing agents that comply with the Standard development Test as defined above in the present description.

EXAMPLE 2

The photographic material of Example 1 was exposed and developed as defined above with the proviso, however, that the developer had the following composition:

| | |
|---|---|
| ethylenediamine tetra-acetic acid sodium salt | 1 g |
| sodium carbonate | 50 g |
| boric acid | 6 g |
| potassium bromide | 2 g |
| sodium sulphite | 30 g |
| hydroquinone | 27.5 g |
| 1-methoxy-2-propanol | 50 ml |
| 1-p-carboxyphenyl-4,4-dimethyl-3-pyrazolidinone | 0.117 g |
| water up to | 1 l |
| pH adjusted to 11 with sodium hydroxide. | |

To same developer portions the anti-fogging agents (AFA) as defined in Table 3 were added. The sensitometrlc results obtained with these compositions are presented in Table 3.

TABLE 3

| Test no. | Antifogging agent | AFA mmole/l | γ v | γ | dot quality rating |
|---|---|---|---|---|---|
| 1 | A | 0.45 | 2.9 | 5.5 | 2–3 |
| 2 | B | 0.59 | 2.6 | 5.4 | 2–3 |
| 3 | C | 0.50 | 2.6 | 5.4 | 2–3 |
| 4 | D | 0.36 | 3.4 | 5.8 | 2 |
| 5 | E | 0.51 | 2.6 | 5.4 | 2–3 |
| 6 | F | 0.44 | 2.6 | 5.4 | 2–3 |

The compounds A to F are anti-fogging agents according to general formula (B) mentioned hereinbefore. Hereinafter the X-substituent is mentioned.

A: p-(COOH),
B: m-($NHCOCH_2SCH_2COOH$),
C: sodium salt of m-(2-sulphobenzamido),
D: m-(2,5-dicarboxybenzamido),
E: m-($NHCOCH_2CH_2COOH$),
F: m-(2-carboxybenzamido).

EXAMPLE 3

The photographic material of Example 1 was exposed as defined above, but the development proceeded as defined in Example 2, with the proviso, that increasing amounts of 5-nitro-indazole (NI) were used as defined in the following Table 4. The results presented in Table 4 show that the relative sensitivity which is a measure for the development activity is reduced directly proportional with the amount of 5-nitro-indazole.

TABLE 4

| Test no. | NI mmole/l | rel. S | γ v | γ | dot quality rating |
|---|---|---|---|---|---|
| 1 | none | 171 | 1.3 | 3.4 | 5 |
| 2 | 0.15 | 200 | 1.9 | 3.7 | 4–5 |
| 3 | 0.30 | 179 | 3.8 | 5.0 | 2–3 |
| 4 | 0.50 | 130 | 5.9 | 7.3 | 1 |

EXAMPLE 4

The photographic material of Example 1, but free from polyethylene glycol, was exposed and developed as defined in Test 3 of Example 1 with the proviso, however, that the developer contained increasing amounts of polyethylene glycol (PG) having an average number of 70 repeating oxyethylene units.

The sensitometric results are listed in the following Table 5.

TABLE 5

| Test no. | PG g/l | rel. S | γ v | γ | dot quality rating |
|---|---|---|---|---|---|
| 1 | none | 241 | 1.8 | 4.8 | 4 |
| 2 | 0.25 | 167 | 3.1 | 5.1 | 2–3 |
| 3 | 0.50 | 159 | 3.9 | 6.7 | 1–2 |
| 4 | 1.50 | 100 | 5.9 | 8.7 | 1 |

EXAMPLE 5

The photographic material of Example 1 was exposed as described in said example and in embodiment 1 developed in a shallow tray automatic processor machine wherein the already mentioned "cross-over" expressed as a percentage of overall development time was 22%.

In embodiment 2 said photographic material was developed in a deep tank automatic developing machine operating with a "cross-over" of 7%.

For comparative purposes the lith-developer (A) of U.S. Pat. No. 3,972,719 and the developer of Test 3 (called herein developer B) of present Example 1 were used.

The sensitometric results are listed in the following Tables 6 and 7.

The development time (t) is expressed in seconds (s).

TABLE 6

| Test no. | developer | (embodiment 1) t (s) | γ v | γ | dot quality rating |
|---|---|---|---|---|---|
| 1 | A | 70 | 1.4 | 5.6 | 4 |
| 2 | B | 40 | 3.8 | 9.2 | 1 |

TABLE 7

| Test no. | developer | (embodiment 2) t (s) | γ v | γ | dot quality rating |
|---|---|---|---|---|---|
| 1 | A | 70 | 3.0 | 10.5 | 1 |
| 2 | B | 40 | 4.2 | 9.2 | 1 |

EXAMPLE 6

A silver bromoiodide emulsion containing 1 mole percent of iodide having a mean grain size of 0.2 μm was chemically sensitized with gold(III) chloride and sodium thiosulphate.

The emulsion was spectrally sensitized to green light and coated onto a polyester film base at a gelatin coverage of 3.4 g per sq.m and at a coverage of silver halide equivalent to 2.9 g of silver.

The silver halide emulsion layer was coated with a protective layer containing formaldehyde hardened gelatin at a coverage of 0.8 g of gelatin per sq.m.

The photographic material was exposed and developed as defined in test 3 of Example 1 with the proviso that the developer contained 0.35 g per litre of polyethylene glycol having an average number of 70 repeating oxyethylene units.

The development resulted in $\gamma_v$: 4.8, $\gamma$: 5.5 and dot quality rating :1.

We claim:

1. A method of effecting high contrast development of an image-wise exposed photographic silver halide emulsion layer material, wherein the development is effected in an aqueous medium which has a pH of 10 to 12 and which contains:

(a)

(i) hydroquinone or a substituted hydroquinone, (ii) an auxiliary developing agent having a developing activity such as to give when tested as the auxiliary development output in the Standard Development Test defined in the specification a relative development rate $f_x$ in the range of about 1–2, (b) free sulphite ions derived from an inorganic sulfite in an amount of at least 5 grams per liter of said aqueous medium, (c) an organic anti-fogging agent corresponding to one of the following general formulae (A) and (B):

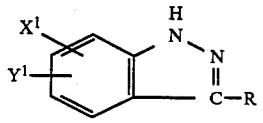

(A)

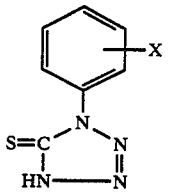

(B)

$Y^1$ is a nitro-substituent in the 5- or 6-position of the indazole nucleus, $X^1$ is hydrogen or a sulphonic acid group in salt form, R is hydrogen or a lower ($C_1$–$C_5$) alkyl group, X is a substituent being or containing a carboxyl group or sulphonic acid group in salt form;

(d) a polymer containing a plurality of alkylene oxide units and having a molecular weight of at least 1500, and (e) an inorganic alkali for imparting said pH to said medium, said ingredients (a) to (d) being present in the aqueous developing medium in such relative amounts that development therein of an exposed photographic material carrying a latent continuous tone wedge image under the same development conditions given a density versus log exposure sensitometric curve of the resulting silver wedge image would have (a) a maximum gradient ($\gamma$) of at least 5 .0 between the log exposure values measured at densities of 0.3 and 3.0 above fog on the log exposure scale and (b) a gradient ($\gamma_v$) of at least 2.0 in the toe between the log exposure values measured at densities of 0.1 and 0.6 above fog on the log exposure scale.

2. Method according to claim 1, wherein hydroquinone and the auxiliary developing agent are used in a molar ratio which ranges between 100/1 to 1000/1.

3. Method according to claim 1, wherein the anti-fogging agent is used in a concentration of 0.05 to 1 g per liter.

4. Method according to claim 1, wherein the aqueous solution has a pH between 10 and 12 and contains 5-nitro-indazole in an amount of 50 to 300 mg per liter.

5. Method according to claim 1, wherein the concentration of the sulphite ions in said aqueous solution is in the range of 15 to 80 g per liter.

6. Method according to claim 1, wherein the polymer containing a plurality of alkylene oxide units is present in said aqueous solution in the range of about 0.01 to 10 g per liter.

7. Method according to claim 1, wherein the polymer containing a plurality of alkylene oxide units is present in said photographic material already before the development.

8. Method according to claim 1, wherein the polymer containing a plurality of alkylene oxide units is a polyoxyethylene glycol with an average molecular weight of at least 1500.

9. Method according to claim 1, wherein the aqueous solution contains free bromide ions in a concentration of 0.2 to 5.0 g per liter.

10. Method according to claim 1, wherein the aqueous solution contains at least one organic watermiscible solvent for the developing agents and/or such anti-fogging agent.

11. Method according to claim 10, wherein the aqueous solution contains a solvent selected from the group consisting of dimethylformamide, dimethylacetamide, N-methyl-2-pyrrolidinone and 3-methoxy-2-propanol.

12. Method according to claim 1, wherein the photographic material contains silver halide comprising at least 70 mole % of silver chloride, the balance, if any being bromide.

13. Method according to claim 1, wherein the photographic material contains as silver halide a silver bromide or silver bromoiodide.

* * * * *